US005480040A

United States Patent [19]

Ryan

[11] Patent Number: 5,480,040

[45] Date of Patent: Jan. 2, 1996

[54] CURTAIN ROD

[75] Inventor: Richard B. Ryan, 1309 Appletree, Libertyville, Ill. 60048

[73] Assignee: Richard B. Ryan, Libertyville, Ill.

[21] Appl. No.: 68,232

[22] Filed: May 27, 1993

[51] Int. Cl.[6] ..... A47F 5/00

[52] U.S. Cl. ..... 211/105.1; 211/105.2; 211/105.3

[58] Field of Search ..... 211/105.2, 105.3, 211/105.1; 248/261, 262, 263, 265

[56] References Cited

U.S. PATENT DOCUMENTS

| | | | |
|---|---|---|---|
| 1,376,541 | 5/1921 | Hills | 211/105.3 X |
| 2,201,043 | 5/1940 | Kirsch | 211/105.3 |
| 2,653,156 | 9/1953 | Dubiell | 211/105.3 |
| 2,890,799 | 6/1959 | Rosenbaum | 211/105.2 |
| 2,918,175 | 12/1959 | Elliott | 211/105.2 |
| 3,430,908 | 3/1969 | Kowalczyk | 211/105.2 X |
| 3,567,261 | 3/1971 | Akczinski | 248/265 X |
| 5,263,594 | 11/1993 | Bianchi | 211/105.2 |
| 5,330,821 | 7/1994 | Lo | 248/265 X |

*Primary Examiner*—Robert W. Gibson, Jr.
*Attorney, Agent, or Firm*—Roper & Quigg

[57] ABSTRACT

A wide pocket curtain rod assembly comprising first and second rod members, each rod member having a first end and a second end, the rod members being slidably engageable via their second ends to form a telescoping curtain rod, each of the rod members having a crimp adjacent their first end which allows each of the members to be hand-bent into an L-shaped member with a facial section and a lateral section, first and second brackets, the brackets attachable to the lateral sections of the rod members for mounting the curtain rod, stiffening ridges, the stiffening ridges connected to the rod members, and an adjustable bracket having a mounting plate having a mounting face and an insert section, an elongated longitudinal aperture and a hand-operable fastener insertable in the aperture for fastening the mounting plate to the rod, wherein the mounting plate is fastened to the rod by inserting the fastener through a fastener hole in the rod and into the aperture.

39 Claims, 6 Drawing Sheets

FIG. 1
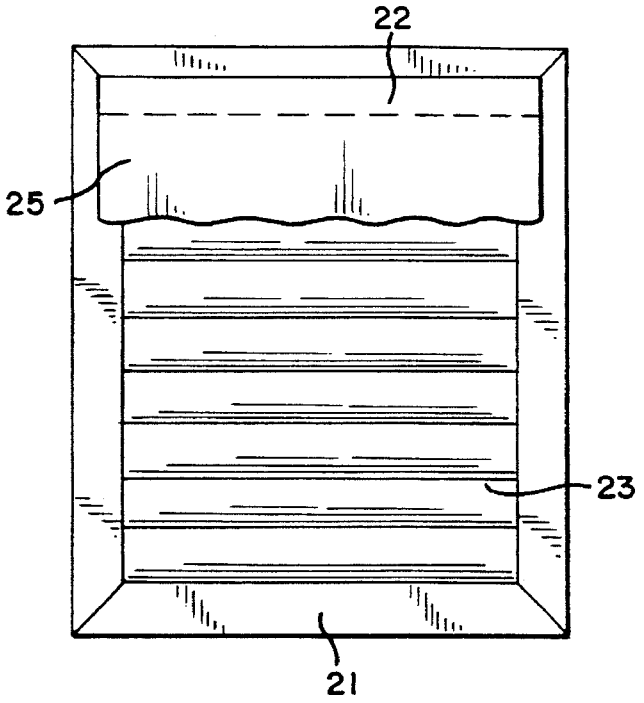
FIG. 2
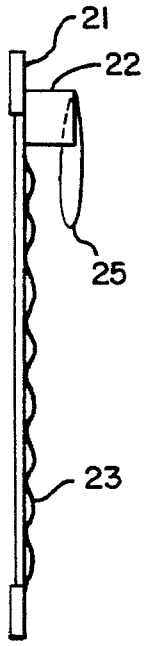
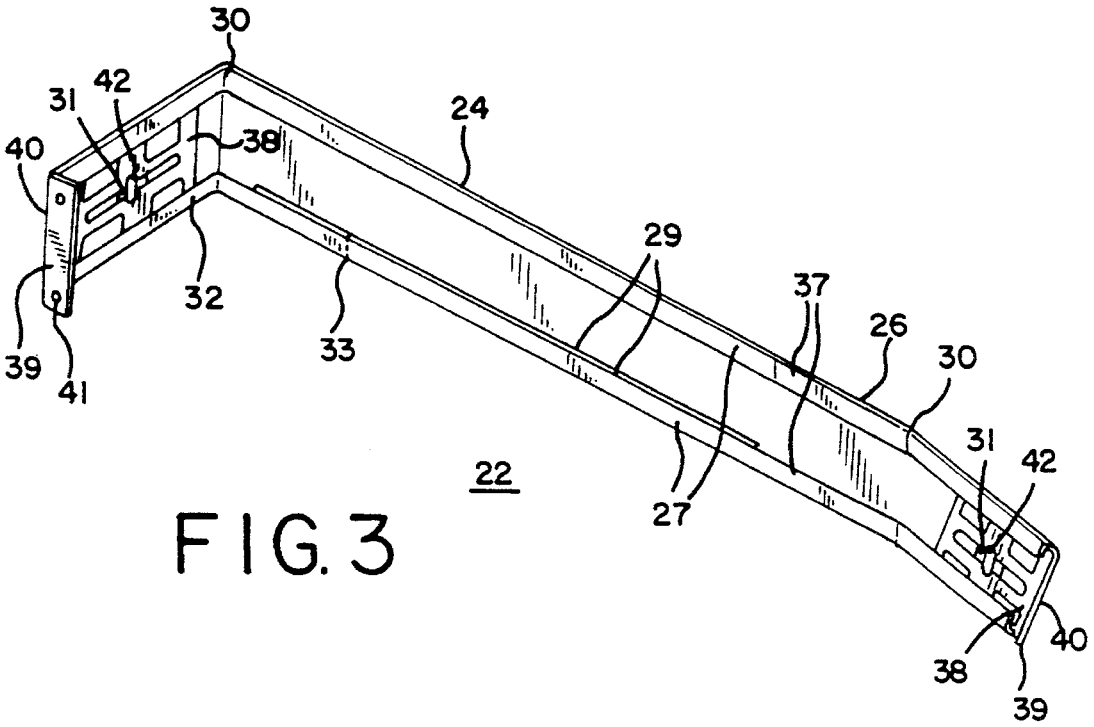
FIG. 3

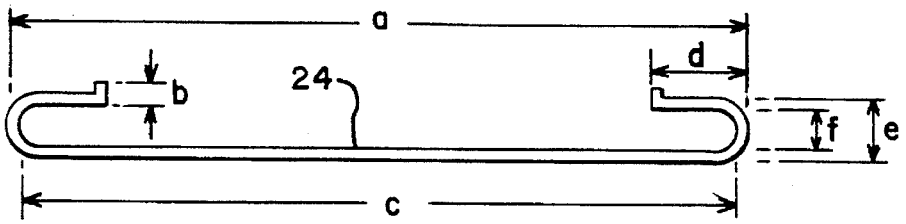
FIG. 8
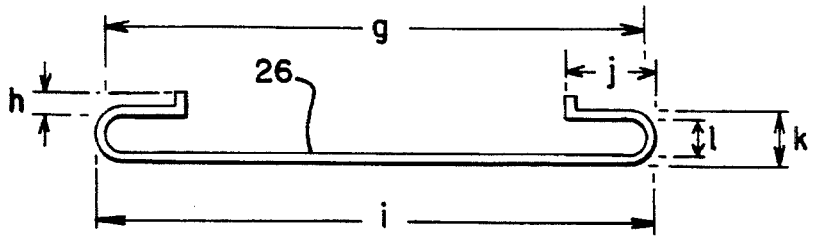
FIG. 9
FIG. 10
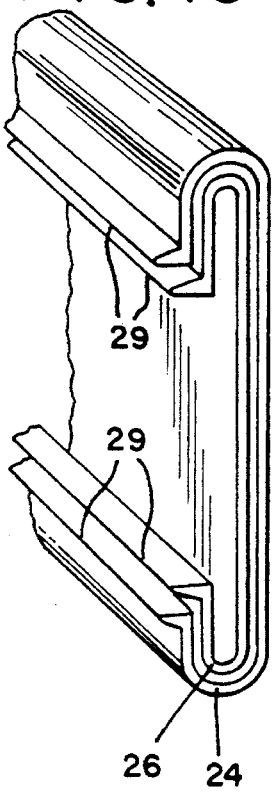
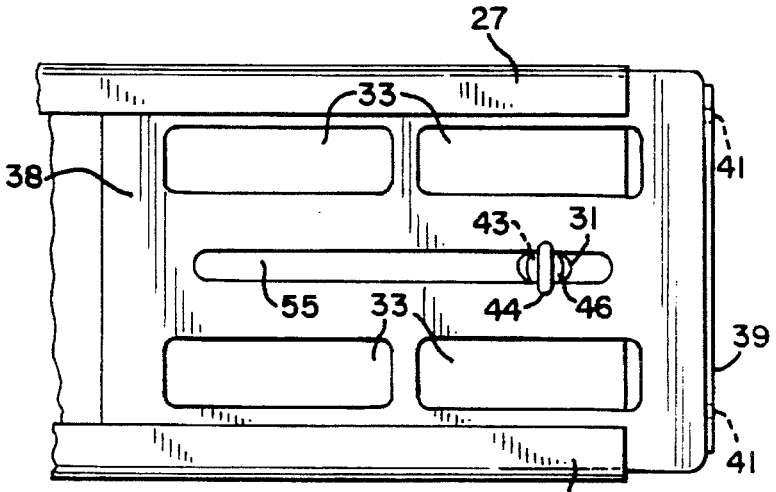
FIG. 11

CURTAIN ROD

TECHNICAL FIELD

This invention relates generally to a window treatment, namely, a valance or topper. A wide pocket curtain rod provides a mounting for the valance or topper. The present invention provides such a curtain rod which is simple and cheap to package and display, simple and cheap to manufacture, hand adjustable in two dimensions, and which allows full extension of the rod without bowing or tilting. The present invention is particularly useful for wide pocket curtain rods.

BACKGROUND ART

A valance (also often called a topper or a top treatment) comprises a short rod pocket curtain mounted on a frame, which includes a curtain rod. A valance does not cover the entire window, rather, it is used as a decorative heading to provide softness and style, and to generally enhance window treatments such as shades or blinds. A typical valance extends across the top of a window and is spaced laterally away from the window frame so that there is sufficient clearance between the valance and the underlying window treatment to avoid interference.

As used herein, and frequently in the art, the "width" of the valance and the underlying curtain rod refers to the horizontal distance of the rod across the top of the window. The "projection" of the valance and underlying rod refers to the distance between the rod and the window frame. The "height" of the curtain rod refers to vertical dimension of the rod. Wide pocket curtain rods are typically at least 5 centimeters in height to accommodate the wide pockets of wide pocket curtains.

Traditional valance rods, called wide pocket curtain rods, fall into two general types of construction. Each type has certain advantages and disadvantages.

The first type, often called "non-projectable," comprises generally two flat L-shaped members that are engaged to form a C-shaped telescoping rod. Each L-shaped member is formed via a single mechanical forming operation which simultaneously crimps and bends a straight member. This bending operation forms a rounded corner, thereby resulting in the L-shaped member. The end user connects the two L-shaped members to form the C-shaped rod, which is adjustable to various widths. The pocket curtain is mounted around this rod. The non-engaged ends of the L-shaped members are attached to a wall or window frame via a bracket such as a steel plate that projects off the wall and includes hooks to engage the ends of the L-shaped members.

This type of rod offers two major disadvantages. First, the rod is non-projectable, which means that the rod has no capability for adjustment in lateral separation from the window frame or wall. Since there is no adjustment of projection, any given rod of this type will only fit over a certain size treatment. Second, the frame has considerable bulk due to the bend at the end of each L-shaped member and the height of the rod required for wide pocket curtains. The required packaging is bulky and expensive and takes up considerable space.

The second general type of rod is frequently called an "adjustable side bracket" rod. Two flat members engage at one end to form a flat telescoping rod. Adjustable side brackets, which generally comprise three pieces, are connected to the non-engaged ends of the flat sections to form a C-shaped telescoping rod. These adjustable side brackets generally are inserted into the ends of the flat sections and are held in place by a frictional fit. They are used to connect the rod to the wall or window frame and allow adjustment of the projection of the rod.

The second type of rod has the advantage of projectability and less bulky packaging. However, this second type of rod suffers from at least one major disadvantage. Assembly of the valance rod and adjustment of the projection is relatively complex and requires the use of tools. In addition, these products involve the manufacture of relatively expensive brackets for assembly.

Both types of valance rods also suffer from an additional problem. When a traditional valance rod is adjusted to fit a wide window and is extended to near its full extension, it tends to do two things. First, it bows or droops downward. This is due to the inherent "slop" in the fit between the two telescoping members which allows the sliding telescopic engagement. Second, it tends to twist or tilt, the top edge of the rod moving forward and the bottom edge moving slightly back, due to the weight of the curtain on the top of the pocket curtain rod. In the prior art construction, this problem was solved by increasing the thickness of the rod, thereby costing more and using more material.

The present invention addresses each of these problems and offers the advantages of both types of rods with the disadvantages of neither.

DISCLOSURE OF INVENTION

The present invention is a ready-to-use, hand-adjustable wide pocket curtain rod which allows for cheap and efficient packaging and storage. It also provides for cheap manufacture while also preventing bowing and twisting of the rod when used on wide windows.

Accordingly, the present invention comprises two rod members that are slidably engaged at one end to form a telescoping curtain rod. The rod members are generally of an elongated "C" in cross section, with the two members being replicas of one another with one rod member being slightly larger than the other so that the smaller of the two can be inserted into the larger for a slidable telescopic fit.

In the present invention, each of the rod members is pre-crimped adjacent its non-engaged end. This allows each member to be easily hand-bent into an L-shaped member with a facial portion and a lateral portion. The crimping allows this operation to be easy and the results to be sure, i.e., the position of the crimp defines the size of the lateral portion. Mounting brackets are connected to the lateral portion of each rod member for mounting of the valance to a wall, window frame, or other location. A pocket curtain is mounted on the rod before the rod is mounted.

The pre-crimping of the present invention distinguishes this invention from all other prior constructions. The crimp of the present invention is preferably wedge-shaped and provides for easy hand-bending.

Pre-crimping each rod member in this manner provides numerous advantages over prior construction. The rod can be packaged and stored flat, saving packaging and storage expenses. The end user hand-bends the rod members into the correct shape just prior to mounting. Pre-crimping the rod members in this manner can be done in conjunction with the other features of the present invention or with conventional wide pocket or standard curtain rods.

Another advantageous aspect of the present invention relates to the mounting brackets that are connected to the lateral portions. The present invention comprises adjustable mounting brackets further comprising a mounting face, an insert portion and an elongated longitudinal aperture. A hand-operable fastener is inserted through a fastener hole in the lateral portion of each rod member and through the aperture so that a retainer extends beyond the aperture. By rotating the fastener so that the retainer is perpendicular to the aperture, a secured gripping engagement is created between rod member, bracket, and fastener which secures the bracket to the rod.

The projection of the wide pocket curtain rod is preferably adjusted by simply pulling out or pushing in the mounted rod. The frictional fit of the mounting bracket, while tight, allows this sort of adjustment with the application of a sufficient amount of force. The projection adjustment can also be accomplished by rotating the fastener to totally release the bracket, adjusting the bracket to the desired dimension, and re-rotating the fastener to lock the bracket in place. This allows for a less precise adjustment, as the bracket is free to slide. Thus, the present invention allows for simple adjustment by hand, with no tools required. The construction of the bracket is also simpler and cheaper to manufacture than the prior art adjustable bracket.

The final aspect of the present invention relates to problems which arise frequently when the rod is fully extended: a bowing of the rod towards the floor and a forward tilting or twisting of the rod. The present invention comprises stiffening ridges along both sides of the length of each slidably connected rod member. These ridges are preferably connected to protruding edges of the rod members. These ridges interact to allow full extension of the valance without bowing or twisting. As with the other features, this feature too can be used in conjunction with or separate from the other features of the present invention. This solution is cheaper and friendlier to the environment than the prior art solution which was simply to increase the thickness of the rod about twice as thick as required by the present invention.

The wide pocket curtain rod of the present invention thus offers the advantage of savings in manufacturing cost and storage cost, is hand-adjustable in two dimensions, and does not bow or twist. Further aspects and advantages of the invention will become apparent upon review of the following detailed description and accompanying illustration of the invention and claims of the invention.

BRIEF DESCRIPTION OF DRAWINGS

For a more complete understanding of the invention, reference should be made to the embodiments illustrated in the accompanying drawings and described below, wherein like referenced numerals designate like or corresponding parts through the several views, and wherein certain features and lines may have been deleted for ease of understanding. The directions referenced ("top", "bottom", etc.) are used with reference to a wide pocket curtain rod actually mounted over a window. In the drawings:

FIG. 1 is a front schematic view of the wide pocket curtain rod and valance mounted on a window.

FIG. 2 is a side schematic view of FIG. 1.

FIG. 3 is a schematic back perspective view of the wide pocket curtain rod partially assembled.

FIG. 8 is a side cut-away view of the first rod member.

FIG. 9 is a side cut away view of the second rod member.

FIG. 10 is a cut-away perspective view of the engaged rod members showing details of the stiffening ridges.

FIG. 11 is a side schematic view of the mounting bracket inserted in the second rod member, viewed from the bracket side.

MODES FOR CARRYING OUT INVENTION

Figure 4:
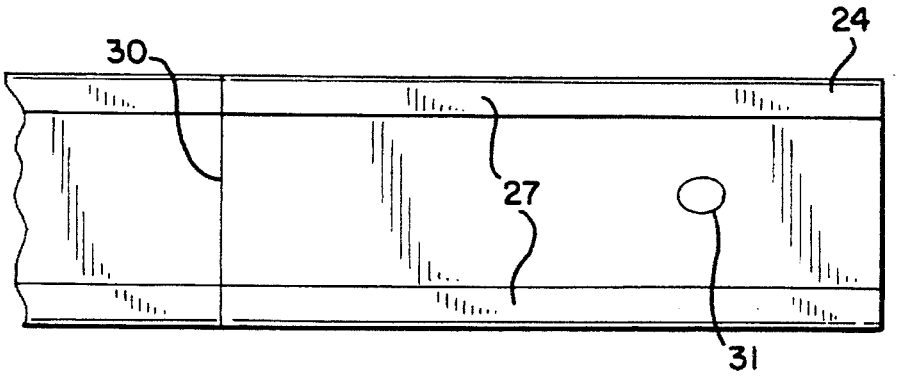
FIG. 4 is a back schematic view of a rod member.

A wide pocket curtain rod is shown mounted above a window in FIG. 1. Wide pocket curtain rod 22 (shown in broken lines as it is hidden by the valance curtain 25) is mounted to window frame 21. Valance curtain 25 covers the top of shade 23. The wide pocket curtain rod of FIG. 1 is shown from the side in FIG. 2.

A wide pocket curtain rod is shown in FIGS. 3–10 which embodies the invention. First rod member 24 is slidably engaged with second rod member 26 to create telescoping curtain rod 28. First rod member 24 and second rod member 26 further comprise crimps 30 adjacent to their non-connected ends and stiffening ridges 29.

Figure 5:
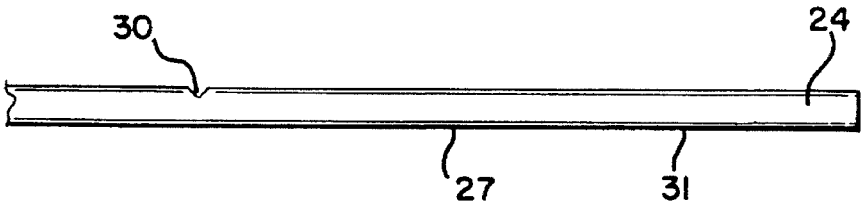
FIG. 5 is a top schematic view of a rod member.

As shown in more detail in FIG. 4 and FIG. 5, crimps 30 are a wedge-shaped indentions formed in the first and second rod members. Although this crimp may be of any shape or size and fashioned in any form that would allow a bend to be made by hand, in the preferred embodiment this crimp is created by a single stamping operation which also forms fastener hole 31. The crimp is preferably about 9 cm. from the end of the rod member, but may be at any suitable distance to give the desired depth to the assembled wide pocket curtain rod and to allow use of a mounting bracket, whether it be the mounting bracket of the present invention or a conventional one. The minimum separation from the wall is determined by the distance between the crimp and the end of the rod member. The single stamping operation lowers manufacturing costs, as does the elimination of the multi-piece adjustable side brackets of the prior art. The crimp also facilitates installation, as no extensive assembly of the frame is required.

The advantages of the present invention are most fully realized with respect to wide pocket curtain rods due to the inherent bulk resulting from the required height of the rods. However, the invention is also applicable to standard curtain rods. Standard curtain rods are designed to accommodate curtains with pockets 2.5 cm. or less. Pre-crimping such standard rods reduces the bulkiness of the product for packaging purposes. The advantages of the present invention are also applicable to one piece wide pocket or standard curtain rods. In such an application, no width adjustment is possible.

Returning to FIG. 3, wide pocket curtain rod 22 further comprises mounting brackets 40 and hand-operable fasteners 42. Mounting brackets 40 generally comprise mounting faces 39, insert sections 38 and mounting holes 41.

Figure 6:
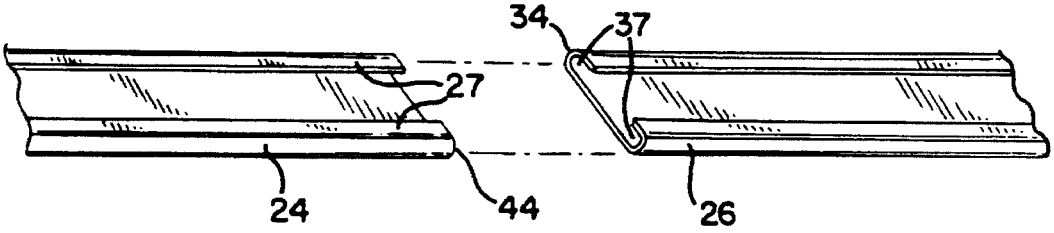
FIG. 6 is an exploded side perspective view of the first and second rod members.
Figure 7:
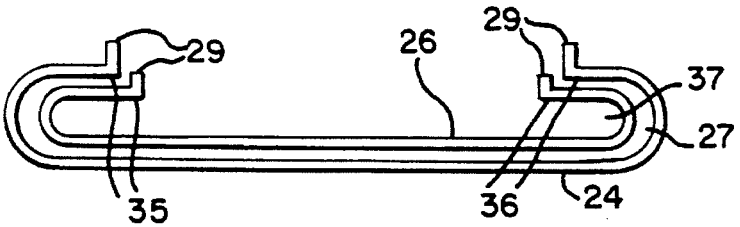
FIG. 7 is a side cut-away schematic view of the wide pocket curtain rod.

Turning to FIG. 6, the relationship of the first rod member to the second rod member is shown in more detail. The first end 34 of second rod member 26 is inserted into the first end 44 of first rod member 24 so that the channels 27 on first rod 24 overlap channels 37 on the second rod 26. The details of this overlap are also shown in FIG. 7, where it can be seen that the inside of channels 27 on first rod 24 fit over the outside of channels 37 and second rod 26 to fashion a slidable telescoping fit. There must be sufficient clearance to allow such a fit. Thus, the dimensions of first rod member 24 are necessarily slightly larger than those of second rod member 26. While any suitable dimensions may be chosen and the conventional dimensions are well known, the preferable dimensions can be seen in FIG. 8 (first rod member) and FIG. 9 (second rod member). Referring to those figures, the preferred dimensions are as follows (all in cm.):

a: 6.56±0.03 (outside measurement)

b: 0.19 c: 6.38 minimum/6.44 maximum (inside measurement)

d: 0.92±0.03–0.0 e: 0.72±0.02 (outside diameter)

f: 0.54±0.02 (inside diameter)

g: 6.14 minimum/6.19 maximum (inside measurement)

h: 0.21±0.001 i: 6.32 minimum/6.38 maximum (outside measurement)

j: 0.95 k: 0.51±0.02 (outside measurement)

l: 0.32±0.02 (inside measurement)

The preferred wall thickness is 0.09±0.006 cm.

As shown in FIGS. 6–9, in the preferred embodiment the first and second rod members further comprise stiffening ridges 29 preferably attached along protruding first and second edges 35 and 36 of the rod member. The ridges may be positioned in any appropriate location along the members, however, and any appropriate number of ridges may be used. When the rod members are telescopically engaged, these ridges, which may be of any suitable height but which are preferably about 0.19 cm. and 0.21 in height (they are preferably slightly taller on the second rod member), rest against each other and prevent bowing and tilting. The interaction of these stiffening ridges is further detailed in FIG. 10. At fuller extensions, due to the necessary slop in the fit, (slop being the necessary spacing between the outside of the channels of the second rod member and the inside of the channels of the first rod member to allow for telescoping engagement and manufacturing tolerances) a traditional telescoping rod would tend to bow in the middle towards the ground as at full extension as there is less overlapping rod length to give support to the rod. The rod would also tilt or twist, with the top edge of the rod moving forward and the bottom edge of the rod moving back, due to the weight of the downward extending valance. The interaction of the ridges 29, as seen in FIG. 10, prevents both the bowing and the twisting. At full extensions these ridges contact and press against each other to prevent both problems. The prior art solved those problems by making the rod members twice as thick, resulting in a higher cost and use of more material.

Such stiffening ridges currently cannot be fabricated in rods made from cold-rolled steel, a common rod material. For that reason, while any suitable material may be used, the rod members with stiffening ridges of the present invention are preferably made from extrudable materials. Such materials include recycled or virgin polyvinyl chloride, other suitable plastics, and recycled or virgin aluminum. Additionally, the stiffening ridges may be used either in conjunction with or independently from the other features of the present invention.

Turning again to FIG. 3, the wide pocket curtain rod is shown partially assembled, after a bend has been made in first rod member 24 at crimp 30. Prior to mounting, the same bend would be made at crimp 30 of second rod member 26. The crimp allows an easy and precise bend to be made by hand. After both bends are made, the rod members are L-shaped members which comprise a lateral portion 32 and a facial portion 33. The valance is installed over the two intersecting facial portions through a pocket or loop in the valance.

Figure 21:
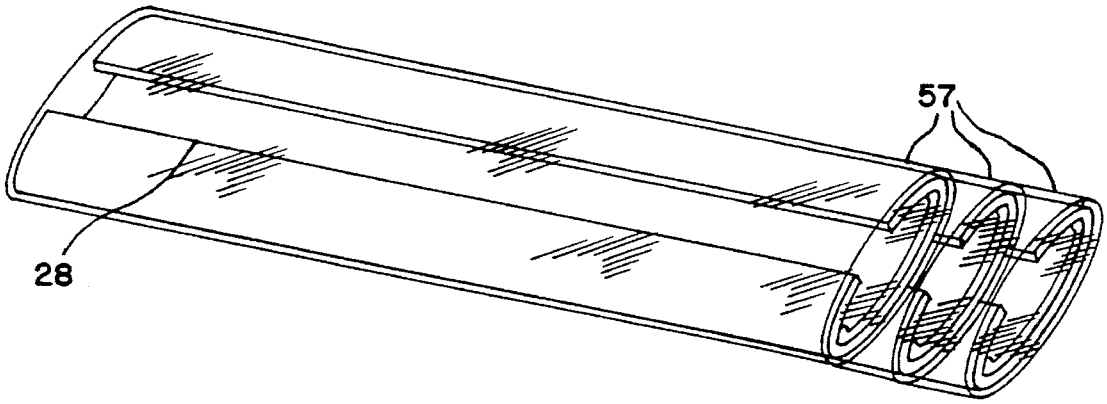
FIG. 21 is a perspective view of packaged, wide pocket curtain rods showing storage alignment.

Non-projectable valance rods necessitate excess packaging expense due to the large package required and the attendant excess storage expense. The present invention is intended to be packaged, stored and sold flat, either with or without a valance installed, eliminating the excess packaging (see FIG. 21). One embodiment of the present invention is a kit comprising a valance and the wide pocket curtain rod sold packaged as a unit, enabling a consumer to buy in one package 57 everything he needed to install a valance.

The details of the preferred embodiment of the mounting bracket 40 of the present invention are shown in FIGS. 11–17. Instead of requiring the multiple pieces of the prior art adjustable side brackets, the mounting bracket is of simple construction. This makes manufacturing cheaper. FIG. 11 shows mounting bracket 40 inserted into second rod member 26. The mounting bracket may be of any suitable material but is preferably injection-molded from polypropylene. The mounting bracket and fastener are further preferably injection-molded as one piece and then separated, further simplifying manufacture. The bracket is inserted into channels 27 and held in place by a fastener, as is described below. If the mounting bracket is used in conjunction with the pre-crimping feature of the present invention, as is shown in the preferred embodiment, this fit is furthered by the inherent narrowing of the channels caused by the crimp. The narrowing of the channels near the crimp creates a tighter fit between the channel and the inserted mounting bracket. More force is required to pull the bracket out, an advantage over prior art construction. A second similar bracket is inserted into channels 37 of the second rod member.

Mounting bracket 40 further comprises mounting face 39 and insert section 38. Cutouts 33 of the bracket allow use of less material in the manufacture but are not required. A solid piece or any variety of cutouts may be utilized. The mounting bracket further defines elongated aperture 55.

Figure 16:
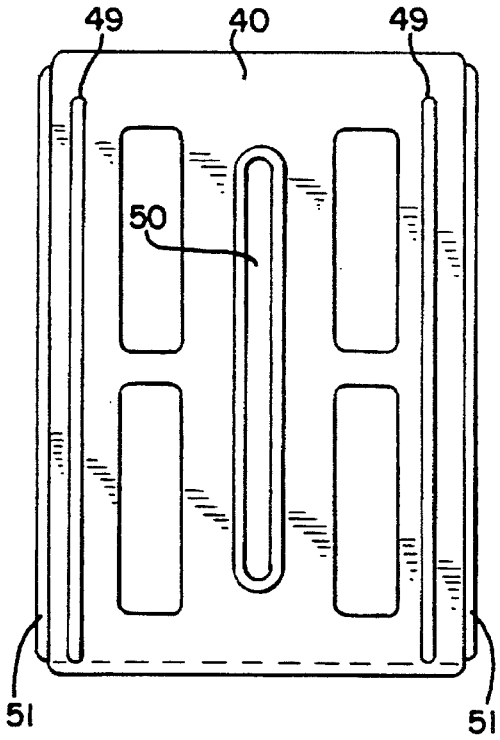
FIG. 16 is a side schematic view of the mounting bracket with extra material added.
Figure 17:
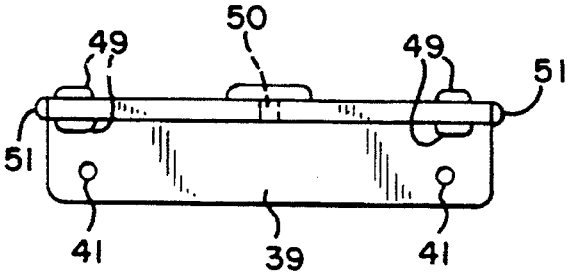
FIG. 17 is an end schematic view of the mounting bracket with extra material added.

Because the channels are of slightly different sizes due to the difference in sizes of the rod members, the brackets should also be of slightly different sizes for a proper fit. While any method may be used to size the brackets, including using solid thicknesses to fill the channels, one manner of accomplishing the sizing is to add additional material to the first sized bracket along its edges and in the form of ribs on its insert section to account for the additional space to fill within the larger channels. This method minimizes the use of extra material and also provides for easy differentiation of the two different sized brackets, as the larger ones can be identified by the ribs. FIG. 16 shows a bracket with such excess material added (see shaded regions). In this embodiment the extra excess material comprises ribs 49, circular rib 50 around the aperture, and slots 51. FIG. 17 is an end view of the same bracket.

Figure 18:
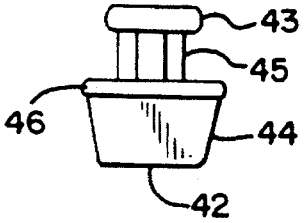
FIG. 18 is a front view of the fastener.
Figure 19:
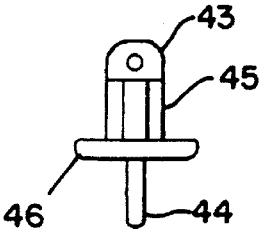
FIG. 19 is a side view of the fastener.
Figure 20:
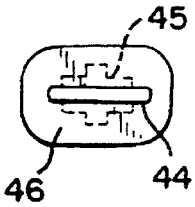
FIG. 20 is a top view of the fastener.

FIGS. 18–20 show three views of the preferred embodiment of fastener 42, which may comprise any suitable configuration. FIG. 18, a front view, shows knob 44, lip 46, throat 45, and retainer 43. In the preferred embodiment, retainer 43 defines a substantially oval cross section, that is, the dimension of the retainer in line with the knob and to be aligned with the aperture and fastener hole prior to rotation is substantially longer than the dimension of the retainer initially perpendicular to the aperture. This allows the fastening action to occur. Any suitable configuration may be used, however. In the embodiment shown in FIG. 18–20, the throat is T-shaped. It too can be of any suitable configuration.

FIG. 19 is a side view of the fastener. FIG. 20 is a top view.

To connect the bracket to the rod, fastener 42 is inserted from the rod member side, through fastener hole 31, and through the elongated aperture. Fastener hole 31 is preferably oval or oblong in shape (as seen for example in FIG. 4) to allow for the fastening operation. To allow a secure connection, the fastener 42 is rotated so that the retainer 43 is perpendicular to and in frictional pressing contact with the aperture edges 48 of elongated aperture 55, holding mounting bracket 40 in place in a secure gripping contact. The bracket is clamped between the retainer and the rod member. This gripping contact occurs due to the resilient nature of the fastener (any suitably resilient material may be used but polyethylene or polypropylene is preferred) and the respective dimensions of the parts. The gap in the fastener between the retainer and the knob, which is slightly smaller than the combined thickness of the bracket and rod member, combined with the resiliency of the fastener, creates a clamping effect when the fastener is rotated. The length of retainer 43 is necessarily larger than the width of aperture, but smaller than the length of the fastener hole. The bracket is squeezed between the rod member and the retainer.

This feature can be used either with the other features of the present invention or independently.

To connect the rod to a wall or other point, mounting screws or other attachment means pass through mounting holes 41 of mounting face 43 into the wall, frame, or other connection point.

Adjustment of the depth of the valance is easy. All that is required for adjustment is that the rod be pulled out or pushed. The fastening action is such that, with sufficient force, this adjustment can be made. Because of the frictional fit and because a certain amount of force is required to adjust the rod, precise adjustments can be easily made. For less-precise adjustments, the fastener can be finger-turned via its knob so that the retainer aligns with the aperture, the rod be moved as desired, and the fastener be re-rotated to move the retainer perpendicular. The sliding adjustable bracket can be used in conjunction with the other features of the present invention, or with conventional wide body or standard curtain rod.

Figure 12:
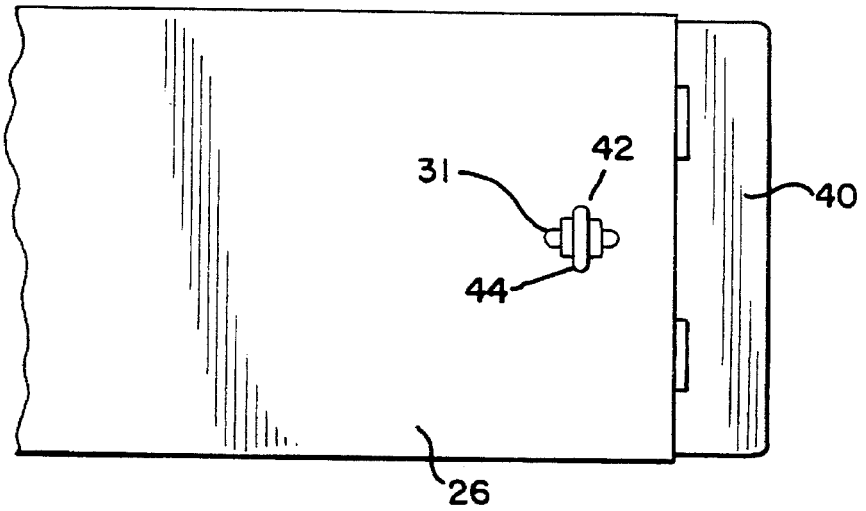
FIG. 12 is a side schematic view of the mounting bracket inserted in the second rod member, viewed from the rod member side.

FIG. 12 shows the details of the mounting bracket from the rod member side. As is seen, knob 44 of fastener 42 is turned perpendicular to fastener hole 31 to retain the mounting bracket in place via retainer 43 (not seen).

Figure 13:
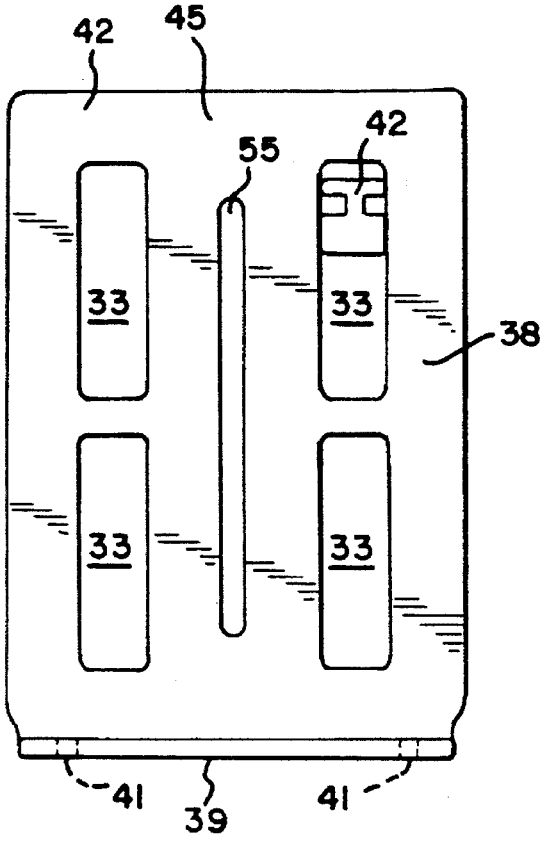
FIG. 13 is a schematic view of the just molded mounting bracket with the fastener included.

FIG. 13 shows a front view of mounting bracket 42. In the preferred embodiment, mounting face 39, through which pass mounting holes 41, lies in a plan substantially perpendicular to insert section 38. Cutouts 33 in addition to allowing for the use of less material in manufacture allow fastener 42 to be molded in the same mold as the bracket, as is shown. They can then be packaged as a unit and separated upon assembly.

Figure 14:
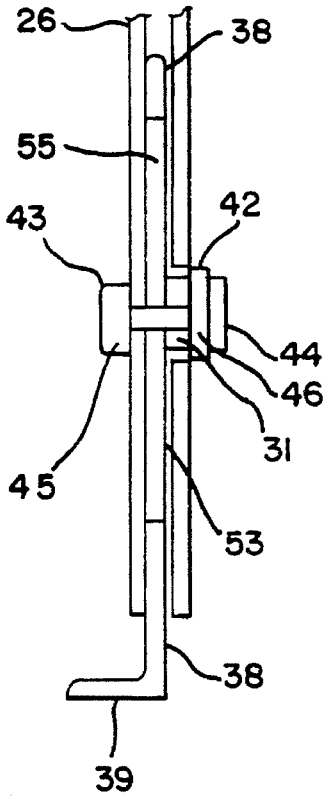
FIG. 14 is a top schematic cut away view of the mounting bracket inserted in the second rod member.
Figure 15:
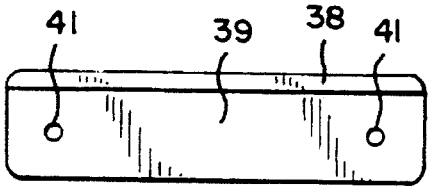
FIG. 15 is a top side schematic view of the mounting bracket.

Turning to FIG. 14, the insertion of fastener 42 into the rod member and the sliding adjustment can be seen in detail. In this view, fastener 42 has not been rotated, but has been inserted through fastener hole 31 of second rod member 26 and aperture 55 of insert section 38, with retainer 43 protruding. Retainer 43 is aligned with fastener hole 31. To fasten the bracket, knob 44 is rotated to turn retainer 43 perpendicular to the aperture and hole. The fit is sufficiently close to cause frictional engagement. The details of the fastener include knob 44, throat 45, lip 46, and retainer 43.

What is claimed is:

1. A curtain rod assembly comprising:

first and second rod members, each of said members having a first and a second end, said first and second rod members being slidably engageable via said second ends to form a telescoping curtain rod, each of said members having a means facilitating bending adjacent said first end and perpendicular to the major axis of said rod member, said means facilitating bending allowing each of said rod members to be bent into an L-shaped member with a facial section and a lateral section, wherein said first and second rod members are engageable prior to bending and are engageable after bending.

2. The curtain rod assembly of claim 1 wherein said first and second rod members are greater than 4.5 cm. in height and wherein the assembly further includes first and second brackets, said brackets attachable to said lateral sections of said first end of each of said members for mounting said curtain rod.

3. The curtain rod assembly according to claim 1 wherein said means facilitating bending is about 9 cm. from said first end.

4. The curtain rod assembly according to claim 1 wherein said rod is fabricated from a material from the following group: recycled aluminum, virgin aluminum, PVC, and recycled PVC.

5. The curtain rod assembly according to claim 2 further comprising stiffening ridges on each of said members, said stiffening ridges interacting when said members are engaged.

6. The curtain rod assembly according to claim 5 further comprising protruding edges on said rod members wherein said stiffening ridges are attached to said edges.

7. The curtain rod assembly according to claim 5 wherein said stiffening ridges are about 0.2 cm. in height.

8. A wide pocket curtain rod assembly comprising:

first and second rod members, each of said members having a first end and a second end and having protruding edges on at least a portion thereof, said first and second members being slidably engageable via said second ends to form a telescoping curtain rod, and at least one stiffening ridge located on the protruding edge of each of said members, said stiffening ridges interacting with each Other when said members are engaged.

9. The wide pocket curtain rod assembly according to claim 8 wherein each rod member has two protruding edges and wherein each edge includes a stiffening ridge.

10. A wide pocket curtain rod assembly comprising:

first and second rod members, each of said members having a first end and a second end, said first and second members being slidably engageable via said second ends to form a telescoping curtain rod, each of said members having a means facilitating bending adjacent said first end and perpendicular to the major axis of said member, said means facilitating bending allowing each of said members to be hand-bent into an L-shaped member with a facial section and a lateral section;

first and second adjustable brackets, said brackets attachable to said lateral sections of said first end of each of said members for mounting said curtain rod, said brackets comprising a mounting plate having a mounting face and an insert section, and an elongated longitudinal aperture; and a hand-operable fastener insertable in said aperture for fastening said bracket to said rod, wherein said bracket is fastened to said rod by inserting said fastener through a fastener hole in said rod and into said aperture.

11. The wide pocket curtain rod assembly according to claim 10 wherein said mounting face is substantially perpendicular to said insert section.

12. The wide pocket curtain rod assembly according to claim 10 wherein said mounting plate is slidingly adjustable by said fastener.

13. The wide pocket curtain rod assembly according to claim 10 wherein said fastener further comprises a knob, a throat, and a retainer, said retainer connected to said knob by said throat.

14. The wide pocket curtain rod assembly according to claim 13 wherein said retainer defines a substantially oval cross section.

15. The wide pocket curtain rod assembly according to claim 10 wherein said bracket is injection molded from polypropylene.

16. A kit for a wide pocket curtain rod assembly comprising:

first and second rod members, each of said members having a first end and a second end, said first and second members being slidably engageable via said second ends to form a telescoping curtain rod, each of said members having a means facilitating bending adjacent said first end and perpendicular to the major axis of said member, said means facilitating bending allowing each of said members to be hand-bent into an L-shaped member with a facial section and a lateral section; and a mounting apparatus.

17. The kit for a wide pocket curtain rod assembly according to claim 16 wherein said mounting apparatus further comprising:

first and second adjustable mounting brackets, said brackets attachable to said lateral sections of said first end of each of said members for mounting said curtain rod, said brackets comprising a mounting plate having a mounting face and an insert section, and an elongated longitudinal aperture; and a hand-operable fastener insertable in said aperture for fastening said mounting plate to said rod, wherein said mounting plate is fastened to said rod by inserting said fastener through a fastener hole in said rod and into said aperture.

18. The kit for a wide pocket curtain rod assembly according to claim 17 further comprising a valance curtain for installing on said first and second members.

19. A method for assembling a wide pocket curtain rod comprising the steps of:

providing first and second rod members, each of said members having a first end and a second end, said first and second members being slidably engageable via said second ends to form a telescoping curtain rod;

providing each rod member with a means facilitating bending adjacent said first end perpendicular to the major axis of said member, said means facilitating bending allowing each of said members to be hand-bent into an L-shaped member with a facial section and a lateral section; and providing first and second mounting brackets, said brackets attachable to said lateral sections of said first ends of said rod members for mounting said curtain rod.

20. The method according to claim 19 further comprising:

hand-bending each of said members at said means facilitating bending into an L-shaped member with a facial section and a lateral section.

21. A curtain rod assembly comprising a curtain rod having a first end, a second end, a major axis, a first means facilitating bending adjacent to said first end and perpendicular to the major axis of said rod member, and a second means facilitating bending adjacent to said second end and perpendicular to the major axis of said rod member, wherein said allow said first end and said second end to be bent to form right angle, L-shaped lateral sections of the rod during field assembly and installation.

22. The curtain rod assembly of claim 21 further including a packaging, wherein said unbent curtain rod is placed within said packaging.

23. The curtain rod assembly of claim 21 wherein said curtain rod is of two-piece construction with a first rod section and a second rod section.

24. The curtain rod assembly of claim 23 wherein said first rod section and said second rod section are formed by telescoping engagement.

25. A method of assembling the curtain rod assembly of claim 21 comprising bending the first end of said curtain rod without the use of a machine to form a first L-shaped lateral section, bending the second end of said curtain rod without the use of a machine to form a second L-shaped lateral section, and mounting said bent curtain rod on a supporting structure.

26. The method of claim 25 wherein said bending is achieving by hand-bending without the use of a tool.

27. The curtain rod assembly of claim 1 further including a packaging, wherein said unbent curtain rod is placed within said packaging.

28. The curtain rod assembly of claim 1 wherein the means facilitating bending is an indentation.

29. The curtain rod assembly of claim 1 wherein the means facilitating bending is a crimp.

30. The wide pocket curtain rod assembly of claim 8 wherein the means facilitating bending is an indentation.

31. The wide pocket curtain rod assembly of claim 8 wherein the means facilitating bending is a crimp.

32. The wide pocket curtain rod assembly of claim 10 wherein the means facilitating bending is an indentation.

33. The wide pocket curtain rod assembly of claim 10 wherein the means facilitating bending is a crimp.

34. The kit for a wide pocket curtain rod assembly of claim 16 wherein the means facilitating bending is an indentation.

35. The kit for a wide pocket curtain rod assembly of claim 16 wherein the means facilitating bending is a crimp.

36. The method of claim 19 for assembling a wide pocket curtain rod wherein the means facilitating bending is an indentation.

37. The method of claim 19 for assembling a wide pocket curtain rod wherein the means facilitating bending is a crimp.

38. The curtain rod assembly of claim 21 wherein the means facilitating bending is an indentation.

39. The curtain rod assembly of claim 21 wherein the means facilitating bending is a crimp.

* * * * *

UNITED STATES PATENT AND TRADEMARK OFFICE

CERTIFICATE OF CORRECTION

PATENT NO. : 5,480,040
DATED : January 2, 1996
INVENTOR(S) : Richard B. Ryan

It is certified that error appears in the above-indentified patent and that said Letters Patent is hereby corrected as shown below:

In Column 10, line 17, after the word "said" add -- first and second means facilitating bending-- such that Claim 21 appears as follows:

21. A curtain rod assembly comprising a curtain rod having a first end, a second end, a major axis, a first means facilitating bending adjacent to said first end and perpendicular to the major axis of said rod member, and a second means facilitating bending adjacent to said second end and perpendicular to the major axis of said rod member, wherein said first and second means facilitating bending allow said first end and said second end to be bent to form right angle, L-shaped lateral sections of the rod during field assembly and installation.

Signed and Sealed this

Ninth Day of July, 1996

*Attest:*

Bruce Lehman

BRUCE LEHMAN

*Attesting Officer*

*Commissioner of Patents and Trademarks*